US005392542A

United States Patent [19]

Chang

[11] Patent Number: 5,392,542

[45] Date of Patent: Feb. 28, 1995

[54] PRESSING IRON SOLEPLATE COATED WITH AN INFRARED HEATER

[76] Inventor: Kwei T. Chang, No.14, Lane 54, Luong Chuan St., Panchiao City, Taipei Hsien, Taiwan, Prov. of China

[21] Appl. No.: 81,122

[22] Filed: Jun. 25, 1993

[51] Int. Cl.[6] ..... D06F 75/38

[52] U.S. Cl. ..... 38/93; 38/81; 219/258

[58] Field of Search ..... 38/80, 81, 82, 93; 219/245, 258, 259, 254, 228, 203; 392/438, 439

[56] References Cited

U.S. PATENT DOCUMENTS

| | | | |
|---|---|---|---|
| 2,179,890 | 11/1939 | Kaplan | 219/258 |
| 2,222,327 | 11/1940 | Walkup | 38/82 X |
| 2,357,905 | 9/1944 | Olving | 38/81 |
| 2,432,106 | 12/1947 | Wesley | 38/82 X |
| 3,098,922 | 7/1963 | Paxton | 219/258 X |
| 3,906,187 | 9/1975 | Turoczi, Jr. | 38/82 X |
| 4,029,935 | 6/1977 | Archer et al. | 38/93 X |
| 4,089,128 | 5/1978 | Baumgartner et al. | 38/93 |
| 4,835,363 | 5/1989 | Hoffmann | 38/82 X |
| 4,931,627 | 6/1990 | Watts | 219/203 X |

FOREIGN PATENT DOCUMENTS

| | | | |
|---|---|---|---|
| 3541424 | 5/1987 | Germany | 219/258 |
| 0907106 | 2/1982 | U.S.S.R. | 219/258 |

*Primary Examiner*—Clifford D. Crowder
*Assistant Examiner*—Ismael Izaguirre
*Attorney, Agent, or Firm*—Browdy and Neimark

[57] ABSTRACT

A soleplate of a pressing iron comprises a soleplate which is made from reinforced transparent glass material and has a flat and smooth bottom surface and a waved upper surface. The upper waved surface is coated with an infrared heater which provides a quick heat build-up thereof to heat the soleplate while preserves the heat generated thereof to a long extent as the power is interrupted.

1 Claim, 4 Drawing Sheets

PRESSING IRON SOLEPLATE COATED WITH AN INFRARED HEATER

BACKGROUND OF THE INVENTION

This invention relates to an improvement on soleplate, more particularly, to an improvement on soleplate of an iron. This improved soleplate can provide a quick build-up of heat on the soleplate and preserve the heat on the soleplate to a higher extent as power interrupts.

The iron has become an inevitable necessity of our daily life, both in laundry and house. In addition to the conventional flatiron, the steam-and-dry iron has also been introduced into the market and more and more people like this steam-and-dry iron. But in both cases, a good pressing effect can only be achieved by a well heated soleplate. The conventional soleplate is made of metal plate and attached to the bottom of the pressing iron. Within the metal-make soleplate, there is a heating coil which transfers the heat generated thereof to the soleplate for pressing as a power is supplied. To this conventional metal-made soleplate, there is a waiting time in heat build-up. If the user wants to use the conventional flatiron immediately, the effect of pressing is poor, besides, as a power is interrupted, the soleplate will lose its heat quickly. As the user uses it again, the soleplate shall be heated by the heating coil again. Not only is the operation poor, but energy is lost as well.

SUMMARY OF THE INVENTION

It is the primary objective of this invention to provide an improvement on the soleplate of a pressing iron which can provide a quick build-up of the heat thereof.

It is still the objectives of this invention to provide an improved soleplate which can preserve the heat build-up thereof to a higher extent as the power is interrupted.

In order to achieve the objects set forth, the improved soleplate made according to this invention includes a soleplate being made from reinforced transparent glass material and having a flat and smooth bottom surface and a waved upper surface, said upper waved surface is coated with an infrared heating means which provides a quick heat build-up thereof to heat the soleplate while preserving the heat generated thereof to a longer extent when power is interrupted.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of an improved soleplate of a pressing iron. In the drawings:

Referring to FIGS. 1 and 2, a pressing iron is comprised of a body 2 and a soleplate 1 attached thereunder. This soleplate 1 according to this invention is made from reinforced transparent glass material. This glass-made soleplate 1 has an excellent sensibility to heat and resists to high heat. As said soleplate 1 is built-up with a high heat, the heat can be kept longer. This improved soleplate has a flat bottom and a waved upper surface 10. Said waved upper surface is coated with an infrared reacted heating means 4 and has two through holes 12 in suitable position. This improved soleplate 10 can be attached to the threaded holes 21 of said body 2 by means of a pair screws 3. As a voltage is supplied to said infrared reacted heating means 4, a great deal of heat can be quickly built-up on said waved surface 10 as incorporated with the reflection effect by said waved surface 10. Not only the heat can be quickly built-up, the heat can be preserved longer.

Figure 1:
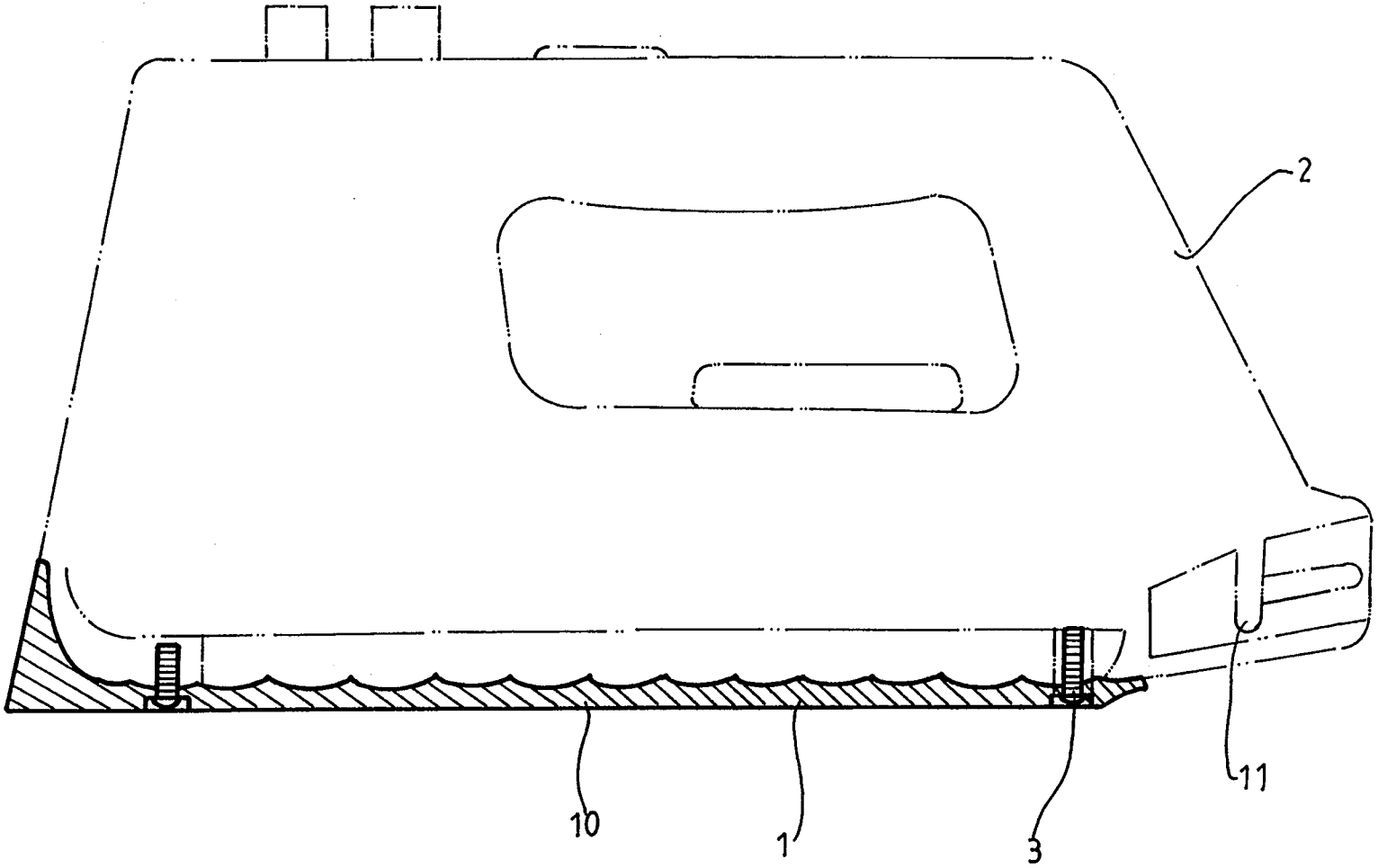
FIG. 1 is a side elevational view of an improved soleplate made according to this instant invention.
Figure 2:
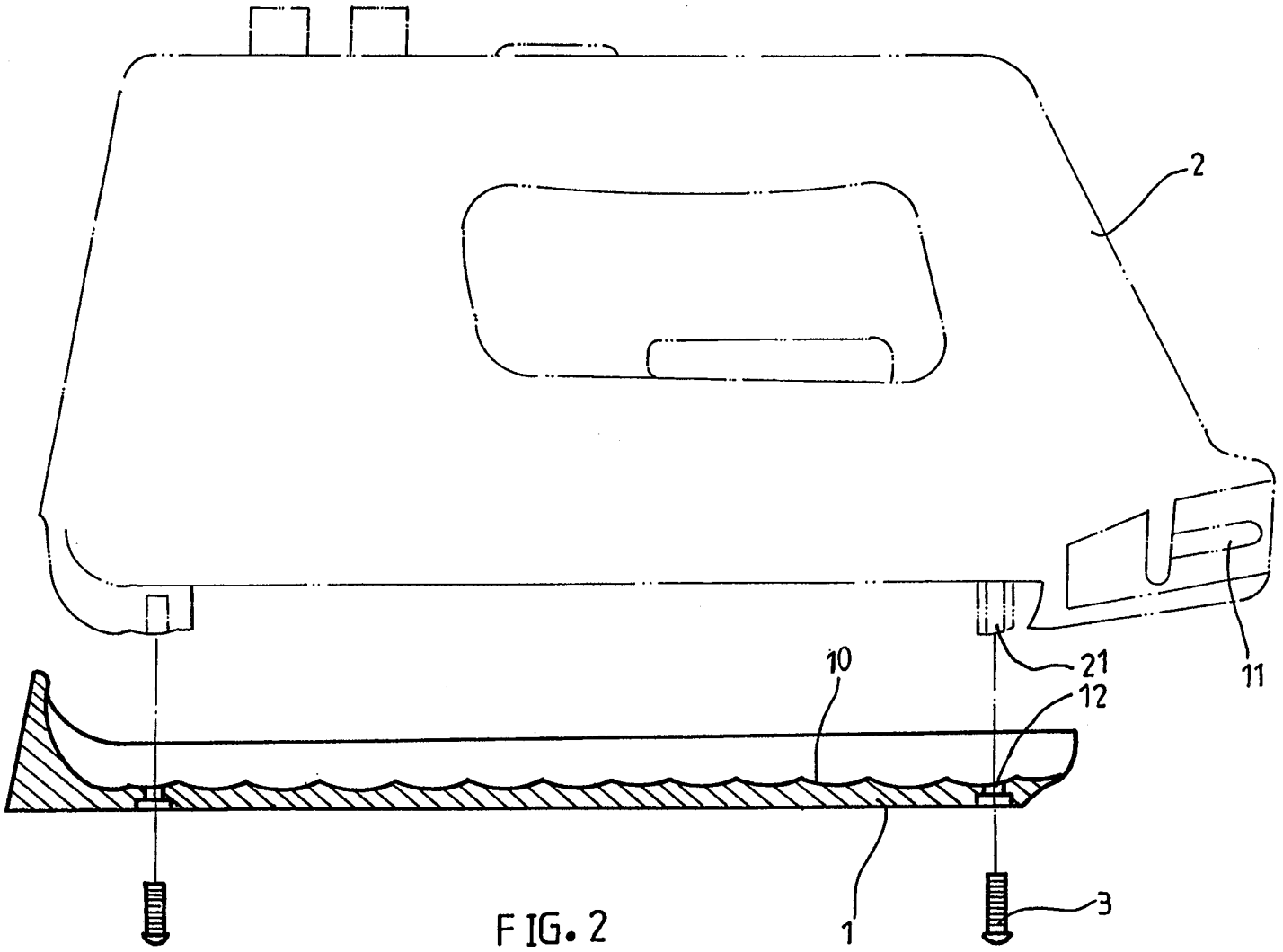
FIG. 2 is another side elevational view of an improvement soleplate made according to this instant invention, showing the improvement soleplate is attached to the bottom of a pressing iron by means of a pair of screws.
Figure 3:
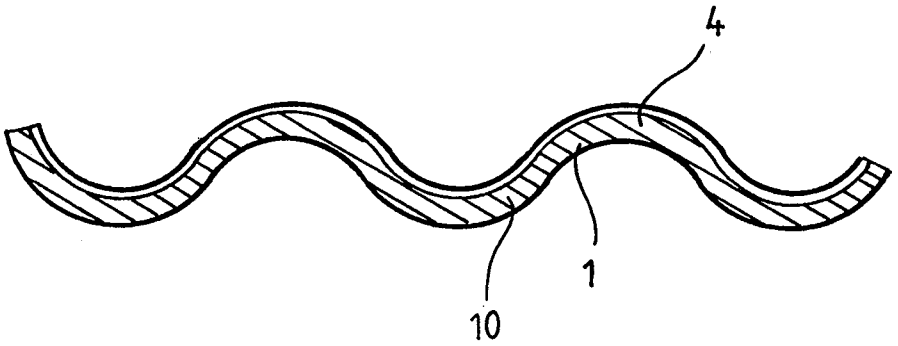
FIG. 3 is an enlarged side elevational view of a waved section of the upper surface of the improvement soleplate.
Figure 4:
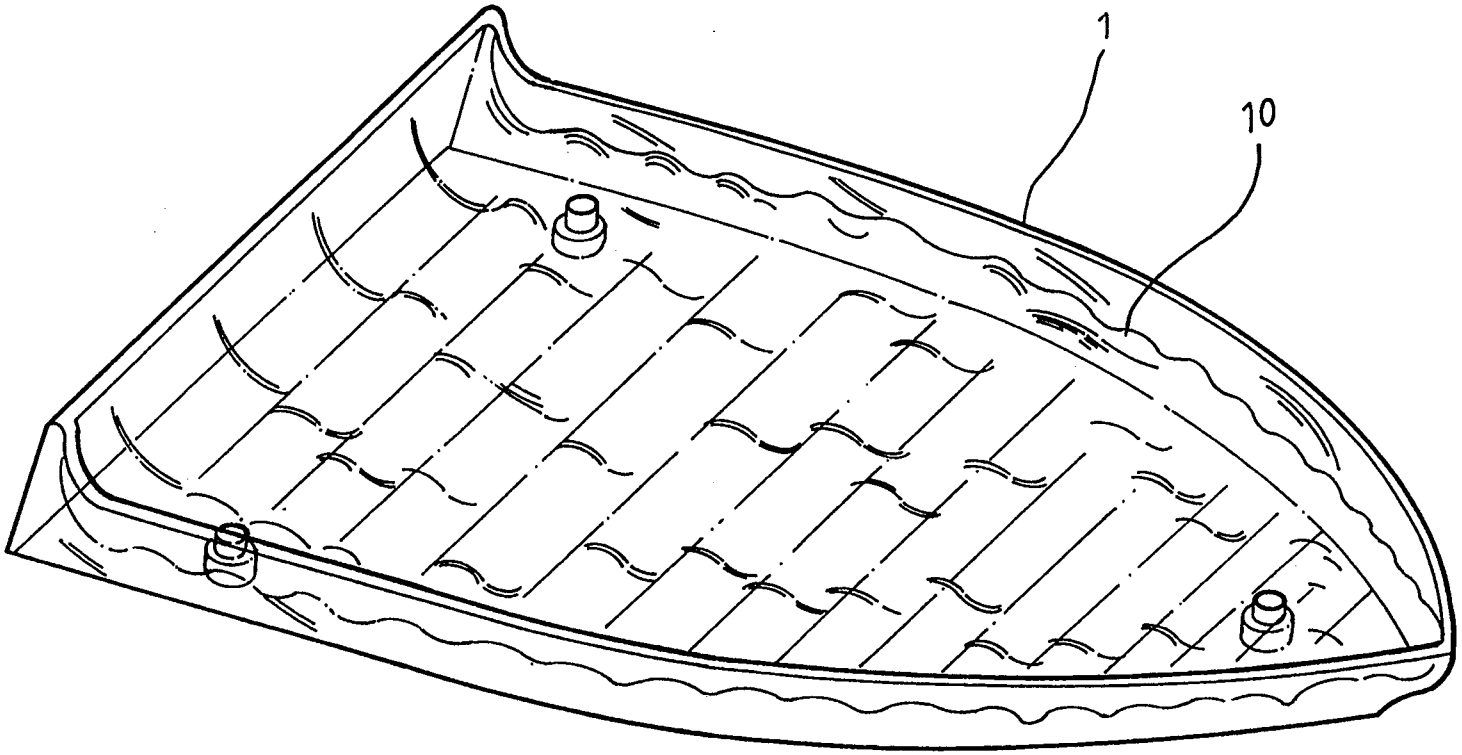
FIG. 4 is a perspective view of an improved soleplate made according to this instant invention.

Because infrared rays have a long wavelength, they have special characteristics which enable them to strike a bronze bell in fixed intervals. Such a bell will resonate because it is within the infrared wave length. In the light spectrum, the infrared has a wavelength of 5.6–1000$\mu$. Since it is an electromagnetic wave it is safe, invisible and has a heating effect. Thus, infrared rays can transfer heat to any body without having to pass through any medium and proceed deeply into the body while generating a heat build-up. In the device according to the invention, the reinforced transparent glass material can generate a quick build-up of such infrared heat at the glass-made soleplate 10. Further, the heat built-up will last even when power is interrupted. This results in an energy saving and high pressing efficiency.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. A soleplate of a pressing iron, said soleplate being made from reinforced transparent glass material and having a flat and smooth bottom surface and a waved upper surface, said upper waved surface being coated with an infrared heating means which provides a quick heat build-up in said infrared heating means when a current is applied directly to said infrared heating means, said infrared heating means heating the soleplate while the soleplate preserves the heat generated by the heating means when power is interrupted and reflects preserved heat from said upper waved surface.

* * * * *